US012297579B2

(12) United States Patent
Lee et al.

(10) Patent No.: US 12,297,579 B2
(45) Date of Patent: May 13, 2025

(54) CLOTHING TREATMENT APPARATUS

(71) Applicant: LG ELECTRONICS INC., Seoul (KR)

(72) Inventors: Jihong Lee, Seoul (KR); Wooseong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 142 days.

(21) Appl. No.: 17/922,192

(22) PCT Filed: Apr. 29, 2021

(86) PCT No.: PCT/KR2021/005494

§ 371 (c)(1),
(2) Date: Oct. 28, 2022

(87) PCT Pub. No.: WO2021/221488

PCT Pub. Date: Nov. 4, 2021

(65) Prior Publication Data

US 2023/0167597 A1 Jun. 1, 2023

(30) Foreign Application Priority Data

Apr. 29, 2020 (KR) ..... 10-2020-0052660

(51) Int. Cl.
*D06F 39/08* (2006.01)
*D06F 105/02* (2020.01)

(52) U.S. Cl.
CPC ..... *D06F 39/085* (2013.01); *D06F 39/088* (2013.01); *D06F 2105/02* (2020.02)

(58) Field of Classification Search
CPC .. D06F 39/085; D06F 39/088; D06F 2105/02; D06F 37/24; D06F 39/08;
(Continued)

(56) References Cited

U.S. PATENT DOCUMENTS 5,868,011 A * 2/1999 Hawkins ..... D06F 39/085 137/247.41
6,474,112 B1 * 11/2002 Han ..... D06F 37/265 68/23.2
(Continued)

FOREIGN PATENT DOCUMENTS

DE 195 37 944 A1 4/1997
JP 2006233791 A * 9/2006
(Continued)

OTHER PUBLICATIONS

Hirata et al., "Self-Priming Electric Pump" Sep. 7, 2006, machine translation of JP-2006233791-A (Year: 2006).*
(Continued)

*Primary Examiner* — David G Cormier
*Assistant Examiner* — Thomas Bucci
(74) *Attorney, Agent, or Firm* — Birch, Stewart, Kolasch & Birch, LLP

(57) ABSTRACT

A clothing treatment apparatus including: a cabinet; a tub disposed inside the cabinet and providing a space in which water is stored; a drum rotatably provided inside the tub; and a pump having a supply port connected to the tub, and a discharge port connected to an outside of the cabinet is provided. The pump includes: a housing; a first chamber disposed inside the housing and communicating with the supply port; a second chamber disposed inside the housing and communicating with the discharge port; a first partition for separating the first chamber and the second chamber; a chamber communicating hole formed in the first partition and communicating the first chamber and the second chamber; an impeller rotatably provided in the second chamber; and a second partition located in the first chamber and extending downward from a first surface of the housing, which provides an upper boundary of the first chamber.

19 Claims, 7 Drawing Sheets

(58) Field of Classification Search
CPC ..... D06F 39/081; F04D 17/08; F04D 9/003; F04D 15/0077; F04D 29/4273; F04D 29/4293; F04D 29/669; A47L 15/4225; A47L 15/4223
USPC ..... 68/3 R
See application file for complete search history.

(56) References Cited

U.S. PATENT DOCUMENTS 6,584,812 B1* 7/2003 Killane ..... D06F 39/085 68/18 F
9,211,049 B2* 12/2015 Lee ..... A47L 15/0036
2008/0276657 A1* 11/2008 Kim ..... D06F 39/083 210/416.1
2011/0214456 A1* 9/2011 Jang ..... D06F 39/085 68/12.19
2012/0186306 A1* 7/2012 Kim ..... D06F 39/10 68/18 F
2013/0074554 A1* 3/2013 Chun ..... D06F 39/085 68/200
2014/0255155 A1* 9/2014 Liang ..... F04D 29/669 415/80
2017/0188781 A1* 7/2017 Lee ..... A47L 15/00
2017/0233937 A1* 8/2017 Kim ..... D06F 39/10 68/207
2017/0356120 A1* 12/2017 Choi ..... F04D 29/506
2020/0149209 A1* 5/2020 Nakashima ..... F04B 53/16

FOREIGN PATENT DOCUMENTS

KR 10-2011-0099967 A 9/2011
KR 10-2017-0006644 A 1/2017
KR 20170006644 A * 1/2017
WO WO 2015/188587 A1 12/2015

OTHER PUBLICATIONS

Lee et al., "Laundry Treating Apparatus" Jan. 18, 2017, machine translation of KR-20170006644-A (Year: 2017).*

* cited by examiner

CLOTHING TREATMENT APPARATUS

CROSS REFERENCE TO RELATED APPLICATIONS

This application is the National Phase of PCT International Application No. PCT/KR2021/005494, filed on Apr. 29, 2021, which claims priority under 35 U.S.C. 119(a) to Patent Application No. 10-2020-0052660, filed in the Republic of Korea on Apr. 29, 2020, all of which are hereby expressly incorporated by reference into the present application.

BACKGROUND

Field of the Invention

The present disclosure relates to a clothing treatment apparatus.

Related Art

In general, a clothing treatment apparatus is a concept including an apparatus for washing clothing (an object to wash, an object to dry), an apparatus for drying clothing, and an apparatus for performing both washing and drying of clothing.

Recently, in order to wash and/or dry a large amount of objects at a time, the capacity of a tub and a drum is increasing in a clothing treatment apparatus.

If a small amount of object is processed using a general clothing treatment apparatus, water and power consumption may be wasted.

Accordingly, a clothing treatment apparatus having smaller size and capacity than those of a general clothing treatment apparatus has been developed.

Such a relatively small-sized clothing treatment apparatus may be designed to have an equal or similar width and a smaller height compared to the general clothing treatment apparatus, and may be positioned on or underneath the general clothing treatment apparatus.

Compared to the general clothing treatment apparatus, a height difference between a water level of water stored in a tub and a water head of a drain pump is relatively small in the clothing treatment apparatus, compared to the general clothing treatment apparatus. As a result, water may not flow quickly from the tub into the drain pump.

When the water from the tub slowly flows into the drain pump, an air layer may be formed inside a housing of the drain pump. Vibration and noise may occur when the drain pump is operated with an impeller of the drain pump exposed to the air.

In the meantime, there is a problem that pumps provided in an existing clothing treatment apparatus freezes at a low temperature. That is, when the temperature is low, residual water in a pump is frozen, and the pump is often damaged while the water is frozen.

SUMMARY

An aspect of the present disclosure is to solve the above and other problems.

Another aspect of the present disclosure provides a clothing treatment apparatus capable of preventing or reducing vibration and noise caused by a pump.

Yet another aspect of the present disclosure provides a clothing treatment apparatus in which an impeller is not exposed to the air even when water from the tub is slowly introduced into a pump.

Yet another aspect of the present disclosure provides a clothing treatment apparatus in which a drainage flow rate per unit time is not reduced even when air is introduced into a pump housing or an air layer is formed.

Yet another aspect of the present disclosure provides a pump for minimizing a risk of freezing and a clothing treatment apparatus provided with the pump.

According to an aspect of the present disclosure for achieving the above objectives, a clothing treatment apparatus includes a tub and a pump.

The clothing treatment apparatus may further include a cabinet.

The tub may be disposed inside the cabinet. The tub may provide a space in which water is stored. The tub may have an extended cylindrical shape. The tub may have a diameter greater than its length.

The tub may include a tub cover forming an upper surface of the tub.

The clothing treatment apparatus may further include a drum. The drum may be rotatably disposed inside the tub. An object may be accommodated in the drum.

The pump includes a supply port connected to the tub and a discharge port connected to the outside of the cabinet.

The pump includes: a housing; first and second chambers disposed inside the housing; a first partition for separating the first and second chambers; a chamber communicating hole for communicating the first and second chambers; and an impeller rotatably disposed inside the chamber.

The first chamber may communicate with the supply port.

The second chamber may communicate with the discharge port.

The chamber communicating hole may be formed in the first partition.

The impeller may be disposed inside the second chamber. The impeller may be rotatably disposed inside the second chamber.

The housing may include a first surface that provides an upper boundary of the first chamber.

The pump may include a second partition positioned in the first chamber. The second partition may extend downward from the first surface of the housing.

The second partition may extend from the first surface of the housing to an edge of the chamber communicating hole.

The second partition may extend from the first surface of the housing to a point located above a center of the chamber communicating hole in the edge of the chamber communicating hole.

The second partition may extend from the first surface of the housing to an uppermost point in the edge of the chamber communicating hole.

The second partition may divide an upper portion of the first chamber into a first upper region and a second upper region.

A partition through-hole for communicating the second chamber with the second upper region may be further included. The partition through-hole may be located in the second upper region. The partition through-hole may be formed in the first partition.

The partition through-hole may be positioned above a lower end of the second partition.

The clothing treatment apparatus may further include an exhaust pipe for communicating the second upper region with the outside of the housing.

The clothing treatment apparatus may further include a flow rate control wall extending from the second partition to the second upper region. The flow control wall may be spaced apart from the housing.

The flow rate control wall may extend between an upper end and a lower end of the partition through-hole. Alternatively, the flow rate control wall may be disposed between the partition through-hole and the chamber communicating hole.

The clothing treatment apparatus may further include a connecting pipe connecting the exhaust pipe and the tub. The connecting pipe may be connected to the tub cover.

The clothing treatment apparatus may further include a residual water discharge pipe for communicating a lower portion of the first chamber with the outside of the housing.

The clothing treatment apparatus may further include a lid configured to open and close the residual water discharge pipe.

The first chamber may include: a passage chamber communicating with the supply port and the chamber communicating hole; and a buffer chamber not communicating with the supply port and the chamber communicating hole. The buffer chamber may be disposed below the chamber communicating hole.

The pump may further include a third partition for partitioning the passage chamber and the buffer chamber from each other.

The second partition may be positioned in the passage chamber.

The third partition may include an inclined surface extending from a second surface of the housing, which provides a lower boundary of the first chamber. The inclined surface may be inclined upward from the supply port in a direction toward the chamber communicating hole.

The third partition may include a guide surface extending downward along an edge of the chamber communicating hole. The guide surface may connect the first surface of the housing and the second surface of the housing and extend downward along the edge of the chamber communicating hole from a surface located opposite the supply port.

The third partition may further include an extension surface connecting the inclined surface and the guide surface. The extension surface may extend parallel to the second surface of the housing.

A pump according to an aspect of the present disclosure may include: a housing providing a space in which water is stored; a housing partition dividing an inner space of the housing into a first chamber and a second chamber; a chamber communicating hole provided to pass through the housing partition to communicate the first chamber and the second chamber; a supply hole for communicating the first chamber with an outside of the housing; a discharge hole for communicating the second chamber with the outside of the housing; an impeller rotatably provided inside the second chamber to move water in a direction toward the discharge hole; and a chamber forming part protruding from an upper surface of the first chamber to a bottom surface of the first chamber so that an air chamber is formed in a space located above the chamber communicating hole in a space provided by the first chamber when water is supplied to the first chamber.

A pump according to an aspect of the present disclosure may include: a housing providing a space in which water is stored; a housing partition dividing an inner space of the housing into a first chamber and a second chamber; a chamber communicating hole provided to pass through the housing partition to communicate the first chamber and the second chamber; a supply hole for communicating the first chamber with an outside of the housing; an discharge hole for communicating the second chamber with the outside of the housing; an impeller rotatably provided inside the second chamber to move water in a direction toward the discharge hole; and a first chamber partition dividing an inside of the first chamber into a passage chamber for guiding water introduced through the supply hole to the chamber communicating hole and a first buffer chamber not communicating with the supply hole and the chamber communicating hole.

According to an aspect of the present disclosure, a clothing treatment apparatus may include: a tub providing a space in which water is stored; a drum having a drum body rotatably provided inside the tub to store clothing and a plurality of communicating holes provided to pass through the drum body to communicate the tub and an inside of the drum body; a pump having a housing, a housing partition dividing an inner space of the housing into a first chamber and a second chamber, a chamber communicating hole provided to pass through the housing partition to communicate the first chamber and the second chamber, a supply hole communicating the first chamber with an outside of the housing, a discharge hole communicating the second chamber with the outside of the housing, and an impeller rotatably provided inside the second chamber to move water in a direction toward the discharge hole; a first drain pipe for guiding water inside the tub to the supply hole; a second drain pipe for providing a movement path of water discharged from the drain hole; and a chamber forming part protruding from an upper surface of the first chamber toward a bottom surface of the first chamber so that an air chamber is formed in a space located above the chamber communicating hole in a space provided by the first chamber when water is supplied to the first chamber.

The chamber forming part may be provided as a board extending from the upper surface of the first chamber to an edge of the chamber communicating hole.

The chamber forming part may be provided as a board connecting the upper surface of the first chamber and a point located above a horizontal line, which passes through a center of the chamber communicating hole, in the edge of the chamber communicating hole.

The chamber forming part may be provided as a board connecting a highest point in the edge of the chamber communicating hole and the upper surface of the first chamber.

The clothing treatment apparatus may further include: a partition through-hole provided to pass through the housing partition to communicate the first chamber and the second chamber and positioned at a position higher than an uppermost end of the chamber communication hole and a free end of the chamber forming part; and an exhaust pipe communicating the first chamber with the outside of the housing.

The clothing treatment apparatus may further include a flow rate control wall protruding from the chamber forming part to be positioned between the partition through-hole and the chamber communicating hole or between the uppermost end of the partition through-hole and a lowermost end of the partition through-hole.

The clothing treatment apparatus may further include a connecting pipe provided to connect the exhaust pipe and the tub and having one end connected to the tub, the one end located at a point higher than a highest water level set in the tub.

The clothing treatment apparatus may include: a residual water discharge pipe provided to discharge water from the first chamber to the outside of the housing; and a lid provided to open and close the residual water discharge pipe.

The clothing treatment apparatus may further include: a first chamber partition dividing the inside of the first chamber into a passage chamber for guiding water introduced through the supply hole to the chamber communicating hole, and a buffer chamber not communicating with the supply hole and the chamber communicating hole.

The chamber forming part may be provided inside the flow chamber.

The clothing treatment apparatus may further include: a cabinet having an outlet at a front surface thereof, and a drawer provided to be withdrawn from the cabinet to provide a space in which the tub is accommodated, the drawer to which the housing is fixed.

According to an aspect of the present disclosure, a clothing treatment apparatus may include: a tub providing a space in which water is stored; a drum having a drum body rotatably provided inside the tub to store clothing and a plurality of communicating holes provided to pass through the drum body to communicate the tub and an inside of the drum body; a pump having a housing, a housing partition dividing an inner space of the housing into a first chamber and a second chamber, a chamber communicating hole provided to pass through the housing partition to communicate the first chamber and the second chamber; a supply hole communicating the first chamber with an outside of the housing, a discharge hole communicating the second chamber with the outside of the housing, and an impeller rotatably provided inside the second chamber to move water in a direction toward the discharge hole; a first drain pipe for guiding water inside the tub to the supply hole; a second drain pipe for providing a movement path of water discharged from the discharge hole; and a first chamber partition dividing an inside of the first chamber into a passage chamber for guiding water introduced through the supply hole to the chamber communicating hole and a first buffer chamber not communicating with the supply hole and the chamber communication hole.

A volume of the passage chamber may be set to be greater than a volume of the first buffer chamber.

One end of the first chamber partition may be fixed to a bottom surface of the first chamber, and the other end of the first chamber partition may be fixed to a side surface of the first chamber.

The first chamber partition may include a guide surface provided to surround an area positioned below the horizontal line of the chamber communicating hole, an extension surface extending from the guide surface in a direction parallel to the bottom surface of the first chamber, and an inclined surface connecting the extension surface and the bottom surface of the first chamber.

The clothing treatment apparatus may further include: an air chamber forming wall protruding from an upper surface of the first chamber toward the chamber communicating hole so that an air chamber is formed in a space located above the chamber communicating hole in a space provided by the passage chamber when a water level of the passage chamber reaches a preset water level; a buffer chamber forming wall provided to connect a free end of the air chamber forming wall and one surface forming the first chamber to form a second buffer chamber separate from the passage chamber, the air chamber, and the first buffer chamber; a partition through-hole provided to pass through the housing partition to connect the second buffer chamber and the second chamber and located at a position higher than an uppermost end of the chamber communicating hole; and an exhaust pipe for discharging air introduced through the partition through-hole to an outside of the second buffer chamber.

The clothing treatment apparatus may further include a buffer chamber partition dividing the second buffer chamber into a space communicating with the partition through-hole and a space not communicating with the partition through-hole.

The buffer chamber forming wall may be provided to connect the air chamber forming wall and one end of the first chamber partition.

The clothing treatment apparatus may further include a connecting pipe provided to connect the exhaust pipe and the tub and having one end connected to the tub, the one end located at a point higher than a highest water level set in the tub.

According to at least one of the embodiments of the present disclosure, it is possible to prevent or reduce vibration and noise caused by the pump.

According to at least one of the embodiments of the present disclosure, even if water slowly flows from the tub into the pump, the impeller may not be exposed to the air.

According to at least one of the embodiments of the present disclosure, even if air is introduced into the pump housing or an air layer is formed, a drainage flow rate per unit time may not be reduced.

According to at least one of the embodiments of the present disclosure, it is possible to minimize a risk of freezing of the pump.

Further scope of applicability of the present disclosure will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

DESCRIPTION OF EXEMPLARY EMBODIMENTS

Figure 1:
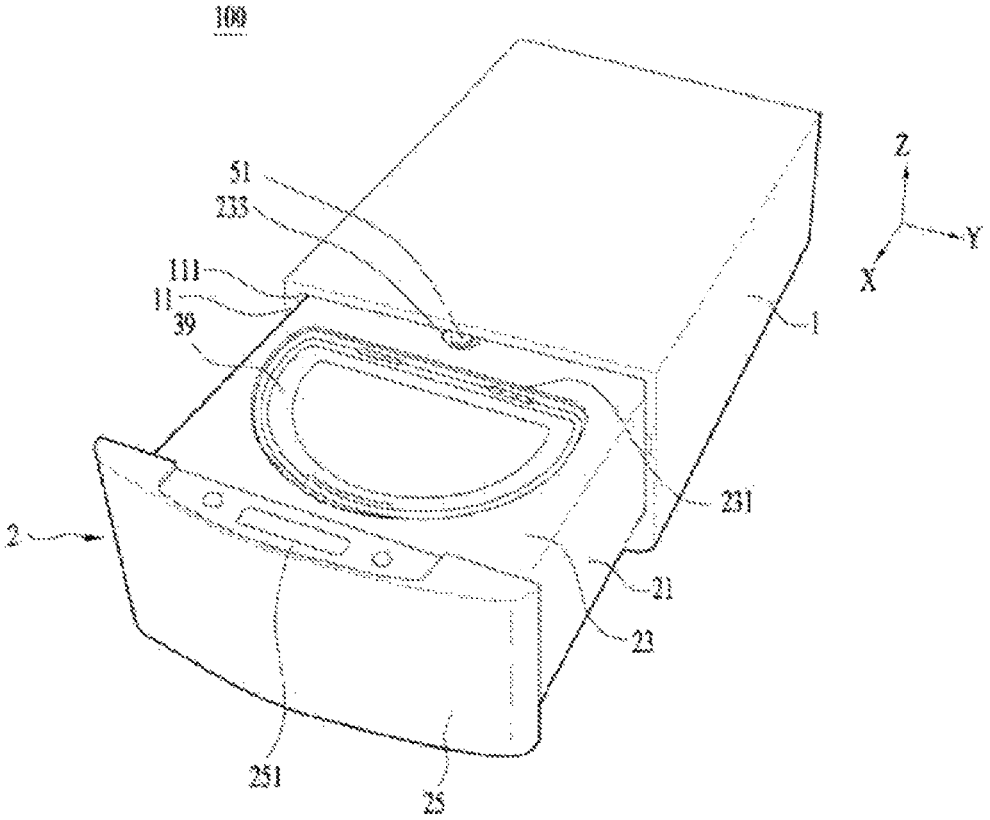
FIGS. 1 and 2 are views showing a clothing treatment apparatus according to an embodiment of the present disclosure.

Hereinafter, embodiments disclosed herein will be described in detail with reference to the accompanying drawings. Regardless of the reference numerals, the same or similar components are assigned the same reference numerals, and overlapping descriptions thereof will be omitted.

The suffixes "module" and "part" for components used in the following description are given or mixed in consideration of only the ease of writing the specification, and do not have distinct meanings or roles by themselves.

In addition, in describing the embodiments disclosed in the present specification, if it is determined that detailed descriptions of related known technologies may obscure the gist of the embodiments disclosed in this specification, the detailed description thereof will be omitted. In addition, the accompanying drawings are only for easy understanding of the embodiments disclosed in the present specification, and the technical spirit disclosed in the present specification is not limited by the accompanying drawings, and all changes included in the spirit and scope of the present disclosure, should be understood to include equivalents or substitutes.

Terms including ordinal numbers such as first, second, etc., may be used to describe various components, but the components are not limited by the terms. The above terms are used only for the purpose of distinguishing one component from another.

When a component is referred to as being "connected" or "connected" to another component, it may be directly connected or connected to the other component, but it is understood that other components may exist in between. On the other hand, when it is said that a certain component is "directly connected" or "directly connected" to another component, it should be understood that the other component does not exist in the middle.

The singular expression includes the plural expression unless the context clearly dictates otherwise.

Figure 2:
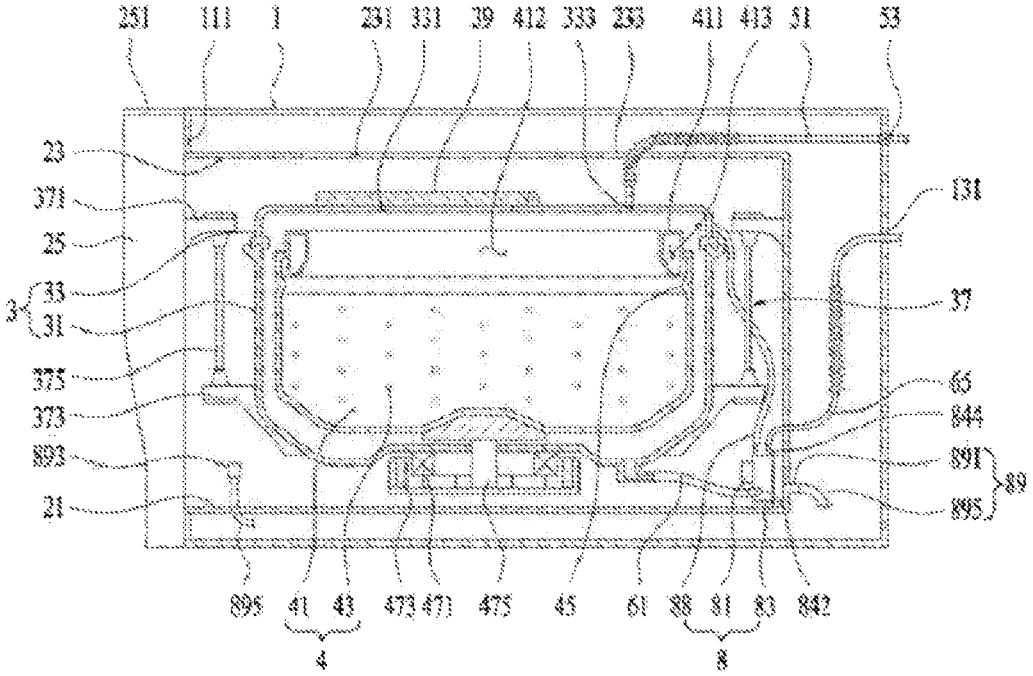

Referring to FIG. 1, a clothing treatment apparatus 100 according to an embodiment of the present disclosure includes a cabinet 1, a tub 3 (see FIG. 2), and a pump 8 (see FIG. 2). The tub 3 may be disposed inside the cabinet 1. The pump 8 may be disposed in the cabinet. The pump 8 may be disposed outside the tub 3.

The cabinet 1 may have an outlet 111 at a front surface 11 thereof.

The clothing treatment apparatus may include a drum 4 (see FIG. 2) rotatably provided inside the tub.

The clothing treatment apparatus may include a drawer 2 to be withdrawn from the cabinet 1 through the outlet 111. The tub may be provided inside the drawer.

The drawer 2 may include a drawer body 21, a drawer cover 23 forming an upper surface of the drawer body, and a drawer panel 25 fixed to the drawer body 21.

The drawer body 21 may be provided in a hexahedral shape with an open upper surface. The drawer cover 23 may be fixed to an upper end of the drawer body 23. The drawer cover 23 may be provided to form an upper surface of the drawer 2.

The drawer panel 25 may open and close the outlet 111. The drawer panel 25 may facilitate withdrawal of the drawer body 21 from the cabinet 1 or insertion of the drawer body 21 into the cabinet 1.

A control panel 251 for controlling the operation of the clothing treatment apparatus 100 may be provided at an upper surface of the drawer panel 25. The control panel 251 may be a means for receiving a control command required for operation of the clothing treatment apparatus from a user. For example, the control panel may be a means (a water supply valve, a pump) for receiving from a user a control command required for operation of a means for supplying or draining water to or from the tub 3, a means for rotating the drum 4 (driving part), or the like. That is, the control panel 251 may be provided with an input part for allowing the user to input a control command to the clothing processing apparatus, and a display part for notifying the user of confirmation of the control command input through the input part or execution of the control command input by the user.

The drawer cover 23 may be provided with an inlet 231 passing through the drawer cover 23 and communicating with the inside of the drawer body 21. The drawer cover 23 may be provided with a cover through-hole 233 passing through the drawer cover 23 and having a water supply pipe 51, which will be described later, inserted thereinto.

The cabinet 1 may have a length in a width direction (Y-axis direction) longer than a length in a height direction (Z-axis direction) (which means that the length in the width direction of the drawer may be longer than the length in the height direction).

Accordingly, the clothing treatment apparatus 100 may be positioned below or above another treatment apparatus capable of washing or drying clothing.

Accordingly, it may be easy for a user to access the control panel 251 and the inlet 231.

Referring to FIG. 2, the clothing treatment apparatus according to an embodiment of the present disclosure may include a tub 3. The tub 3 may extend in a cylindrical shape. The tub 3 may have a diameter greater than a length (height) thereof. The tub 3 may provide a space in which water is stored. The tub 3 may be disposed in the drawer 2.

The tub 3 may include a tub body 31 extending in a cylindrical shape having a diameter greater than a length. The tub body 31 may be opened upward. The tub body 31 may provide a space in which water is stored.

The tub 3 may include a cover 33 forming an upper surface of the tub 3.

The tub body 31 may be provided in a cylindrical shape with an open upper surface. The width of the drawer body 21 may be set to be greater than the height of the drawer body, and the width of the tub body 31 may be set to be greater than the height of the tub body.

The tub body 31 may be supported inside the drawer body 21 by the tub support part 37. The tub support part 37 may include a first bracket 371 protruding from the drawer body 21 toward a circumferential surface of the tub body 21, a second bracket 373 protruding from the circumferential surface of the tub body 31 toward a side surface of the drawer body and provided at a lower position than that of the first bracket 371, and a support bar 375 having one end (an upper end) connected to the first bracket 371 and the other end (a lower end) connected to the second bracket 373. The tub support part 37 having the above-described structure may be provided as a plurality of units, which are spaced apart from each other at the same angle with reference to a vertical line passing through the center of the tub body 21.

The tub cover 33 may be provided with a tub inlet 331 and a water supply port 333 for communicating an inner space of the tub body 31 with the outside.

The tub inlet 331 may be provided to be positioned below the inlet 231, and may be provided to be opened and closed by a door 39 rotatably coupled to the tub cover 33. Since the door 39 is positioned below the inlet 231, the door 39 may be rotated in a direction to open the tub inlet 331 when the drawer is withdrawn from the cabinet. One end of the water supply pipe 51 to be described later may be fixed to the water supply port 333.

The drum 4 may include a drum body 41 that is rotatably provided inside the tub 3 to provide a space for storing clothing. The drum body 41 may be provided in a cylindrical shape with an open upper surface or a cylindrical shape having a through-hole in an upper surface thereof. A plurality of drum communicating holes 43 for communicating the inside of the drum body 41 with the inside of the tub 3 may be provided in at least one of a circumferential surface and a bottom surface of the drum body 41.

The above-described drum body 41 may be rotated by a driving part. The driving part may include a stator 471 fixed to the bottom surface of the tub body 31 and positioned outside the tub 3, a rotor 473 rotated by a rotating magnetic field provided by the stator 471, and a rotational shaft 475 connecting the drum body 41 and the rotor 473 through the bottom surface of the tub body 31. As shown in the drawings, the rotational shaft 475 may be provided to form a right angle with respect to the inlet 231 (to form a right angle with respect to the bottom surface of the tub body).

A balancer 411 may be provided at an upper end of the drum body 41. The balancer 411 is a means for damping vibration generated in the drum body at the event of rotation of the drum body 41. The balancer 411 may include a balancer housing fixed to an upper end of the drum body 41, a housing through-hole (drum inlet) 412 passing through the balancer housing to communicate with the inside of the drum body, a circulation passage 413 provided the housing inside the balancer housing and having a ring shape surrounding the housing through-hole, and a liquid movable along the inside of the circulation passage 413.

The clothing treatment apparatus 100 having the above-described structure may receive water through a water supply passage. The water supply passage may include a water supply pipe 51 connecting the water supply port 333 and a water supply source located outside the cabinet, and a water supply valve 53 for controlling opening and closing of the water supply pipe in accordance with a control signal from a controller.

Meanwhile, water stored in the tub 3 may be discharged to the outside of the cabinet 1 through a drain passage. The drain passage may include a first drain pipe 61 connecting a bottom surface of the tub body 31 and a pump 8 to be described later, and a second drain pipe 65 guiding water discharged from the pump 8 to the outside of the cabinet 1. A cabinet through-hole 131 through which the second drain pipe 65 passes may be provided at a rear surface of the cabinet.

The pump 8 may be disposed outside the tub 3. The pump 8 may be fixed to the drawer body 21 or the cabinet 1. For example, as shown in FIG. 2, the pump 8 may be fixed to the drawer body 21.

The pump 8 may include a supply port 842 connected to the tub 3 and a discharge port 844 connected to the outside of the cabinet 1. The first drain pipe 61 may be connected to the supply port 842, and the second drain pipe 65 may be connected to the discharge port 844. Hereinafter, the supply port 842 may also be referred to as a supply pipe 842, and the discharge port 844 may also be referred to as a discharge pipe 844.

The pump 8 includes a housing 83 and an impeller 82 disposed inside the housing. The pump 8 may include a motor 81 that rotates the impeller 82.

The housing 83 may be fixed to the inside of the drawer body 21.

Figure 3:
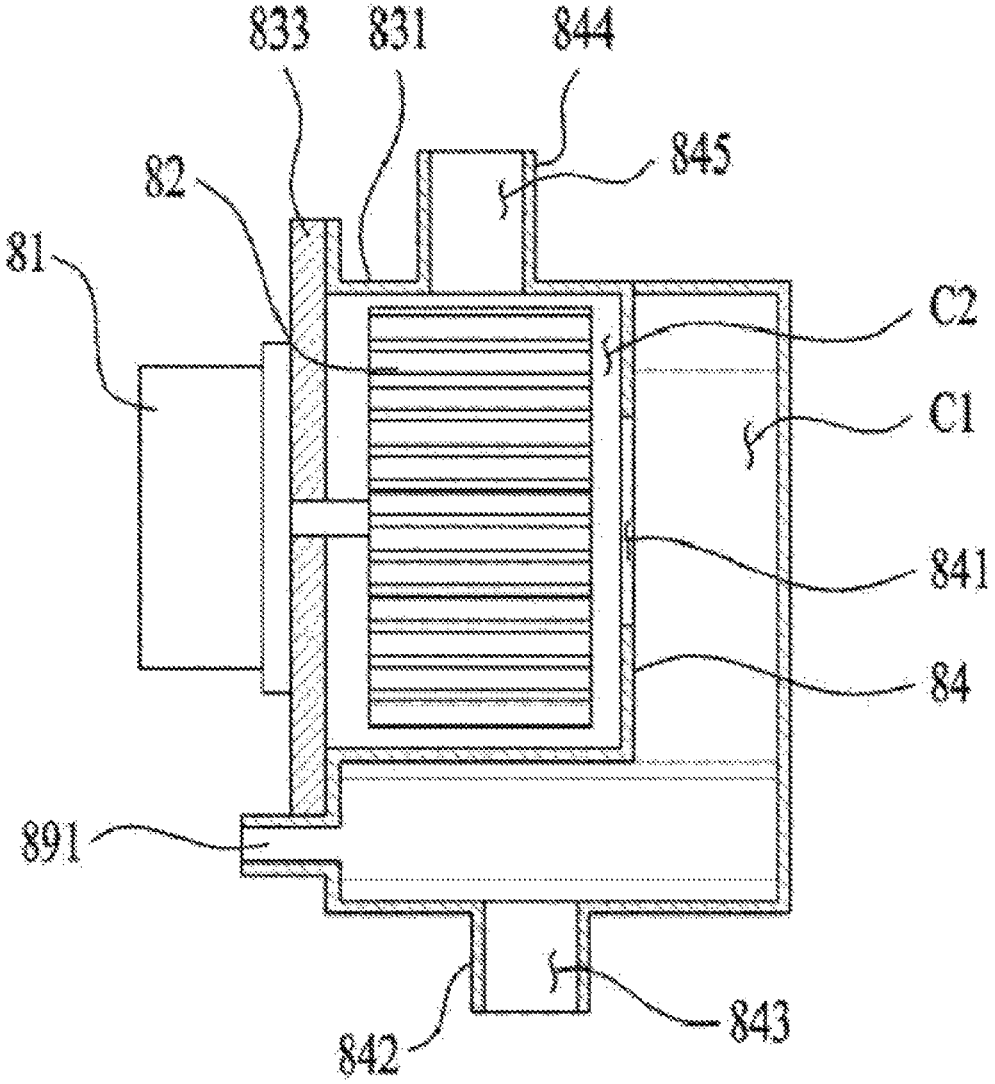
FIGS. 3 and 4 show an example of a pump.

Referring to FIG. 3, the housing 83 may include a first body 831 provided with the supply pipe 842 and the discharge pipe 844, and a second body 833 provided to close an open surface of the first body 831. The motor 81 may be fixed to the second body 833, and a rotational shaft of the motor 81 may pass through the second body 833 to be connected to the impeller 82 located inside the housing.

The housing 83 is provided with a first chamber C1 and a second chamber C2, which are separated by a housing partition 84. The housing partition 84 may be provided as a board to divide a space formed by the first body 831 into two spaces. In this case, the first chamber C1 may be defined as a space formed by the first body 831 and the housing partition 84, and the second chamber C2 may be defined as a space formed by the housing partition 84, the first body 831 and the second body 833. Hereinafter, the housing partition 84 may also be referred to as a first partition 84.

A supply hole 843 communicating with the supply pipe 842 is provided in the first chamber C1, a discharge hole 845 communicating with the discharge pipe 844 is provided in the second chamber C2, and the first chamber C1 and the second chamber C2 are connected to each other through a chamber communicating hole 841 provided to pass through the housing partition 84. Accordingly, when the impeller 82 rotates inside the second chamber C2, water in the first chamber C1 flows into the discharge pipe 844 through the chamber communicating hole 841 and the discharge hole 845.

The housing partition 84 may minimize noise and vibration generated at the event of rotation of the impeller 82.

As described above, the tub 3 provided in the clothing treatment apparatus 100 may have a cylindrical shape with a diameter greater than a height thereof. The tub 3 having such a shape has a smaller water storage capacity than that of a general tub (in a cylindrical shape having a height greater than a length thereof). In addition, since the tub 3 and the pump 8 are provided inside the drawer body 21 whose width is set to be greater than a height, a difference in height between a bottom surface of the tub 3 and the pump 8 is large.

When an amount of water stored in the tub 3 is small and a difference in height between the bottom surface of the tub and the pump is small, a speed at which water is supplied to the housing 83 of the pump may be slow. When water is slowly supplied to the pump without the housing partition 84, an air layer may be formed in an upper area of the housing and an upper portion of the impeller 82 may be exposed to the air layer. When the impeller rotates in this state, the water inside the housing may not be well discharged and vibration and noise may be induced in the pump.

However, if the housing partition 84 dividing a space into the first chamber C1, into which water is introduced, and the second chamber C2, in which the impeller 82 is positioned, is provided in the housing 83 and the chamber communicating hole 841 connecting the two chambers is provided in the housing partition 84, it is possible to solve a problem that a water level of water flowing from the first chamber C1 to the second chamber C2 becomes lower than an uppermost end of the chamber communicating hole 841.

When the housing partition 84 is provided inside the housing 83 with spaces having the same volume, a volume of a space (first chamber) into which water is first introduced is reduced, so a water level of water inside the first chamber C1 may be maintained relatively high even if water flows into the first chamber C1 at a low speed. The fact that that a water level of the first chamber C1 can be maintained high means that a possibility for the water level to be lower than the uppermost end of the chamber communicating hole 841 (a possibility of air to be introduced into the second chamber) is minimized. Therefore, the clothing treatment apparatus 100 may prevent or reduce noise and vibration caused by air introduced into a space in which the impeller 82 is provided.

In order to minimize the volume of the housing 83, the housing partition 84 may be further provided with an impeller receiving groove 847 protruding from the second chamber C2 to a direction in which the first chamber C1 is positioned. The chamber communicating hole 841 may be located in the impeller receiving groove 847.

Figure 4:
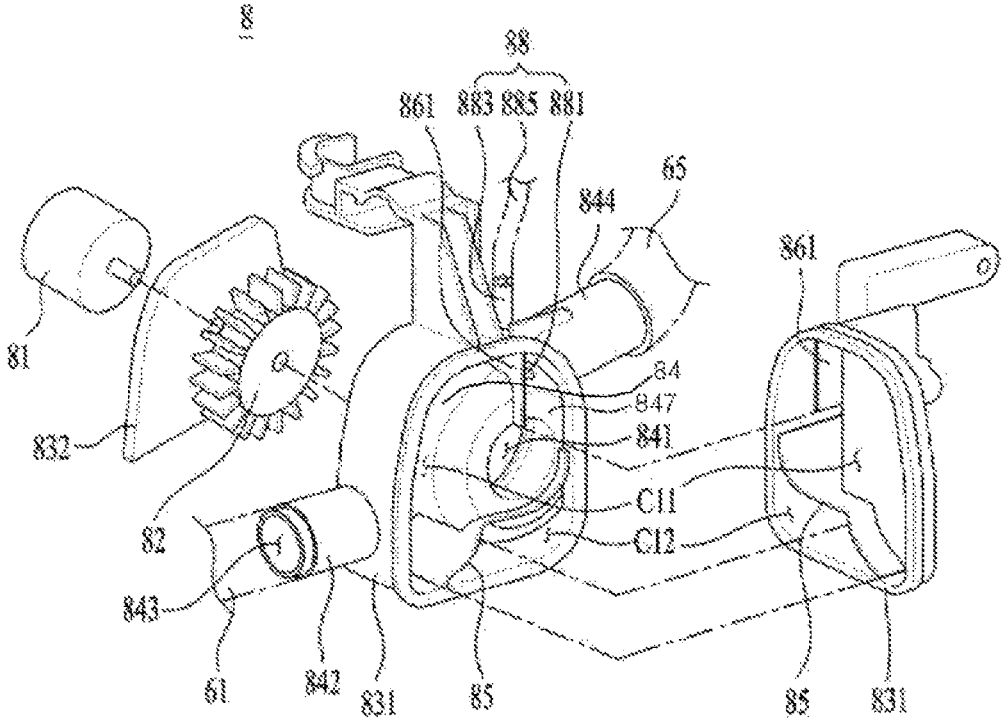

Referring to FIG. 4, in order to minimize noise and vibration caused by air introduced into the second chamber C2, the pump 8 may further include an air venting part 88.

The air venting part 88 may include a partition through-hole 881 provided to pass through the housing partition 84 to communicate the first chamber C1 and the second chamber C2. The air venting part 88 may include an exhaust pipe 883 to communicate the first chamber C1 and the outside of the housing 83.

The partition through-hole 881 is provided to be located at a point higher than the uppermost end of the chamber communicating hole 841 and a free end of a chamber forming part 861 to be described later, and the exhaust pipe 883 may be provided as a pipe that passes through the first body 831 to communicate with the first chamber C1. Therefore, air inside the second chamber C2 may be discharged to the outside of the housing 83 through the partition through-hole 881 and the exhaust pipe 883.

The air venting part 88 may further include a connecting pipe 885 that connects the exhaust pipe 883 and the tub 3. One end of the connecting pipe 885 connected to the tub 3 may be connected so as to be located at a point higher than a highest water level set in the tub 3. Accordingly, it is possible to prevent water in the tub 3 from moving to the first chamber C1. For example, one end of the connecting pipe 885 may be fixed to the tub cover 33 (see FIG. 2).

The pump 8 having the above-described structure may minimize a possibility for air to be introduced into the second chamber C2.

Meanwhile, when the temperature is lowered, the chambers C1 and C2 or the impeller 82 may be damaged. When a volume of the first chamber C1 is reduced, water remaining inside the first chamber C1 may be easily frozen. When the remaining water inside the first chamber C1 is frozen, water inside the second chamber C2 may also be frozen. In this process, the second body 833 or the impeller 82 on which the motor is supported may be damaged.

Figure 5:
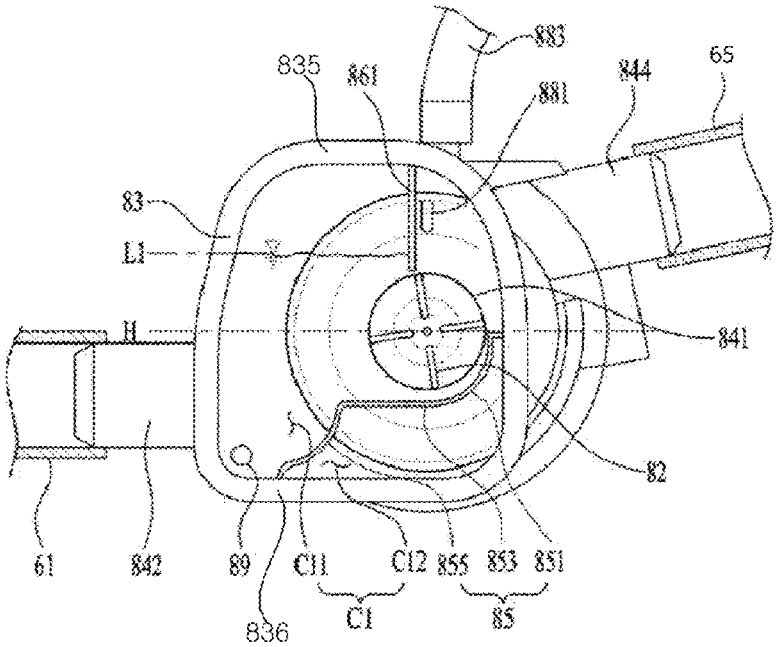
FIGS. 5 and 6 show examples of a first chamber partition and an air chamber forming wall provided in a pump.

Referring to FIGS. 4 and 5, the first chamber C1 may further include the chamber forming part 861. Accordingly, it is possible to prevent damage to the pump 8 caused by freezing of water inside the housing 83. Hereinafter, the chamber forming part 861 may also be referred to as a second partition 861.

When water is supplied to the first chamber C1, the chamber forming part 861 may form an air chamber in a space located above the chamber communicating hole 841 out of a space provided by the first chamber C1. The chamber forming part 861 may be provided as a wall (an air chamber forming wall) protruding from an upper surface 835 of the first chamber C1 toward a bottom surface of the first chamber C1.

Hereinafter, the upper surface 835 of the first chamber may also be referred to as a first surface 835 of the housing. Hereinafter, a bottom surface 836 of the first chamber may also be referred to as a second surface 836 of the housing.

The first surface 835 of the housing may be defined as a surface that provides an upper boundary of the first chamber C1. The second surface 836 of the housing may be defined as a surface that provides a lower boundary of the first chamber C1.

For example, as shown in FIG. 4, the chamber forming part 861 may be provided as a wall connecting an uppermost point of the chamber communicating hole 841 and an upper surface of the first chamber C1. For example, as shown in FIG. 5, the chamber forming part 861 may be provided as a wall that connects the upper surface of the first chamber C1 and a point located above a horizontal line H, which passes through the center of the chamber communicating through-hole 841, in an edge of the chamber communicating hole 841.

When a water level L1 inside the first chamber C1 is higher than an upper end of the chamber communicating hole 841, an air chamber may be formed in an upper space of the first chamber C1 (which is a space formed by a water surface, the chamber forming part, and the first body).

Since the air chamber prevents heat exchange between the air outside the housing 83 and the water inside the first chamber C1, there is an effect that the air chamber prevents the water inside the first chamber C1 and the second chamber C2 from being easily frozen.

In addition, even if the water inside the first chamber is frozen, the water inside the first chamber C1 will be frozen while expanding in volume in a direction in which the air chamber is located, and thus, the air chamber formed by the chamber forming part 861 may minimize a risk of damage to the first chamber C1 and the second chamber C2.

In order to minimize a risk of damage to the pump 8 caused by freezing of the water inside the housing 83, the pump 8 may be further provided with a first chamber partition 85, which divides the inside of the first chamber C1 into a passage chamber C11 for guiding water introduced through the supply hole 843 to the chamber communicating hole 841 and a buffer chamber (a first buffer chamber) C12 not communicating with the supply hole 843 and the chamber communicating hole 841. In this case, the chamber forming part 861 may be provided in the passage chamber C11. Hereinafter, the first chamber partition 85 may also be referred to as a third partition 85.

A volume of the passage chamber C11 may be set to be greater than a volume of the first buffer chamber C12. Accordingly, it is possible to minimize a reduction in the amount of water that the pump 8 can discharge per unit time.

One end of the first chamber partition 85 may be fixed to the bottom surface 836 of the first chamber C1, and the other end thereof may be provided as a wall fixed to a side surface of the first chamber C1. For example, the first chamber partition 85 includes a guide surface 851 provided to surround an area located below the horizontal line H among the chamber communicating holes 841, and an inclined surface 855 connected to an extension surface 853 and the bottom surface of the first chamber C1 and inclined upward toward the guide surface 851.

The first chamber partition 85 may further include the extension surface 853 connecting the guide surface 851 and the inclined surface 855. The extension surface 853 may extend in a direction parallel to the bottom surface of the first chamber C1.

The inclined surface 855 may be inclined upward toward the extension surface 853. The guide surface 851 may be provided in a shape surrounding an edge of the chamber communicating hole 841.

Therefore, water introduced into the passage chamber C11 may be able to quickly move to the chamber communicating hole 841.

A height of a point at which the first chamber partition 85 is connected to the side surface of the first chamber C1 may be set to be equal to or lower than a height of a horizontal line H passing through the center of the chamber communicating hole 841.

The inside of the first buffer chamber C12 may be empty. The first buffer chamber C12 may prevent heat exchange between the air outside the housing 83 and the water inside the first chamber C1, so that the first buffer chamber C12 can prevent the water inside the first chamber C1 and the second chamber C2 from being easily frozen.

In addition, since the first buffer chamber C12 provides a space necessary for ice to expand in volume when the water inside the first chamber C12 is frozen, a possibility of damage to the first chamber C1 and the second chamber C2 may be minimized.

Meanwhile, a residual water discharge part 89 may discharge the water inside the first chamber C1 to the outside of the housing 83. The residual water discharge part 89 may minimize a risk of damage to the pump 8 due to freezing of water.

For example, as shown in FIG. 3, the residual water discharge part 89 may include a residual water discharge pipe 891 for discharging water in the first chamber C1 (water inside the passage chamber) to the outside of the housing 83. In addition, the residual water discharge part 89 may further include a lid that is detachably provided at the residual water discharge pipe 891 to control opening and closing of the residual water discharge pipe 891.

For example, as shown in FIG. 2, an extension pipe 895 may be connected to the residual water discharge part 89. One end of the extension pipe 895 may be connected to the residual water discharge pipe 891, and the other end thereof may be detachably fixed to the drawer body 21. The lid 893 may be detachably provided at a free end of the extension tube 895.

Figure 6:
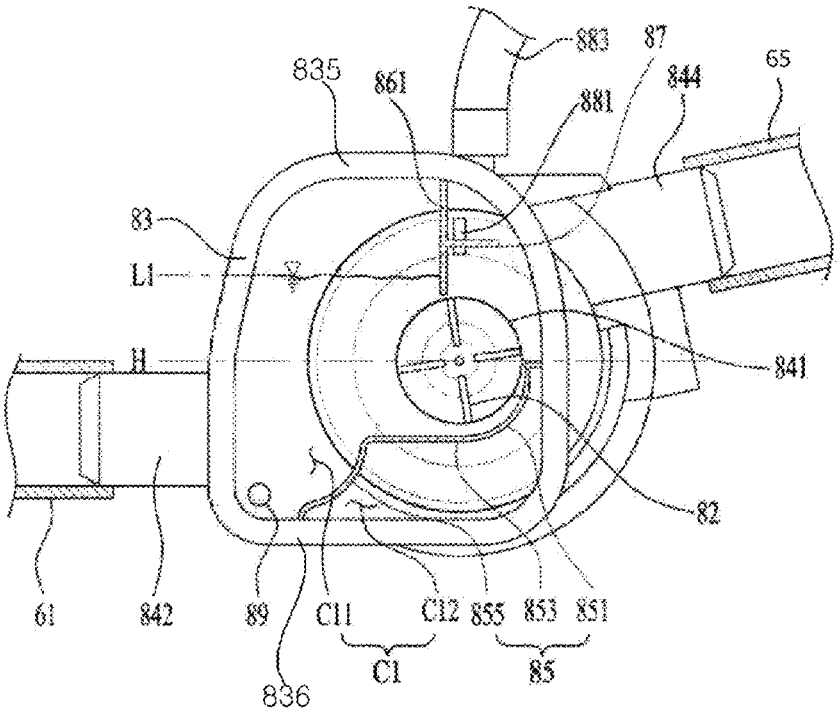

Referring to FIG. 6, the pump 6 may further include a flow rate control wall 87. The flow rate control wall 87 may be provided as a board protruding or extending from the chamber forming part 861 toward a side surface of the first chamber C1. A free end of the flow rate control wall 87 may be spaced apart from the side surface of the first chamber C1. In addition, the flow rate control wall 87 may be positioned between an uppermost end of the partition through-hole 881 and the chamber communicating hole 841. That is, the flow rate control wall 87 may be provided as a wall crossing the partition through-hole 881, and may be provided as a wall positioned between a lowermost end of the partition through-hole 881 and an uppermost end of the chamber communicating hole 841. FIG. 6 shows the former case where the flow rate control wall 87 is provided as a wall crossing the partition through-hole 881, and the flow rate control wall 87 may be positioned between an uppermost end of the partition through-hole 881 and a lowermost end of the partition through-hole 881.

When the impeller 82 rotates, water inside the passage chamber C11 may flow into the second chamber C2. Therefore, pressure inside the second chamber C2 may become relatively higher than pressure inside the passage chamber C11. When there is air in the second chamber C2, the air may flow into the passage chamber C11 through the partition through-hole 881.

Meanwhile, when a water level in the passage chamber C11 is not high enough, the air in the passage chamber C11 may flow back into the second chamber C2. The flow rate control wall 87 forms a bottleneck-shaped passage between the passage chamber C11 and the partition through-holes 881. That is, a cross-sectional area of a space connecting the passage chamber C11 and the partition through-hole 881 is reduced by the flow rate control wall 87. In a case where the bottleneck-shaped passage is formed between the passage chamber C11 and the partition through-hole 881, even if the air flows back into the passage chamber C11 from the second chamber C2, it may be possible to reduce an amount of air flowing to the chamber communicating hole 841 in the air backflow. The flow rate control wall 87 has an effect of minimizing a reduction in the amount of drainage of the pump due to the air flowing back to the partition through-hole881.

In addition, as shown in FIG. 6, when the flow rate control wall 87 is positioned between the upper end and the lower end of the partition through-hole 881, water inside the passage chamber C11 may be introduced into the second chamber C1 through a portion of the partition through-hole 881 located below the flow rate controlling wall 87, and air inside the second chamber C1 may be introduced into the first chamber C1 through a portion of the partition through-hole 881 located above the flow rate control wall 87.

Therefore, the flow rate control wall 87 positioned between the upper end and the lower end of the partition through-hole 881 may minimize the introduction of air from the first chamber C1 to the second chamber C2.

Figure 7:
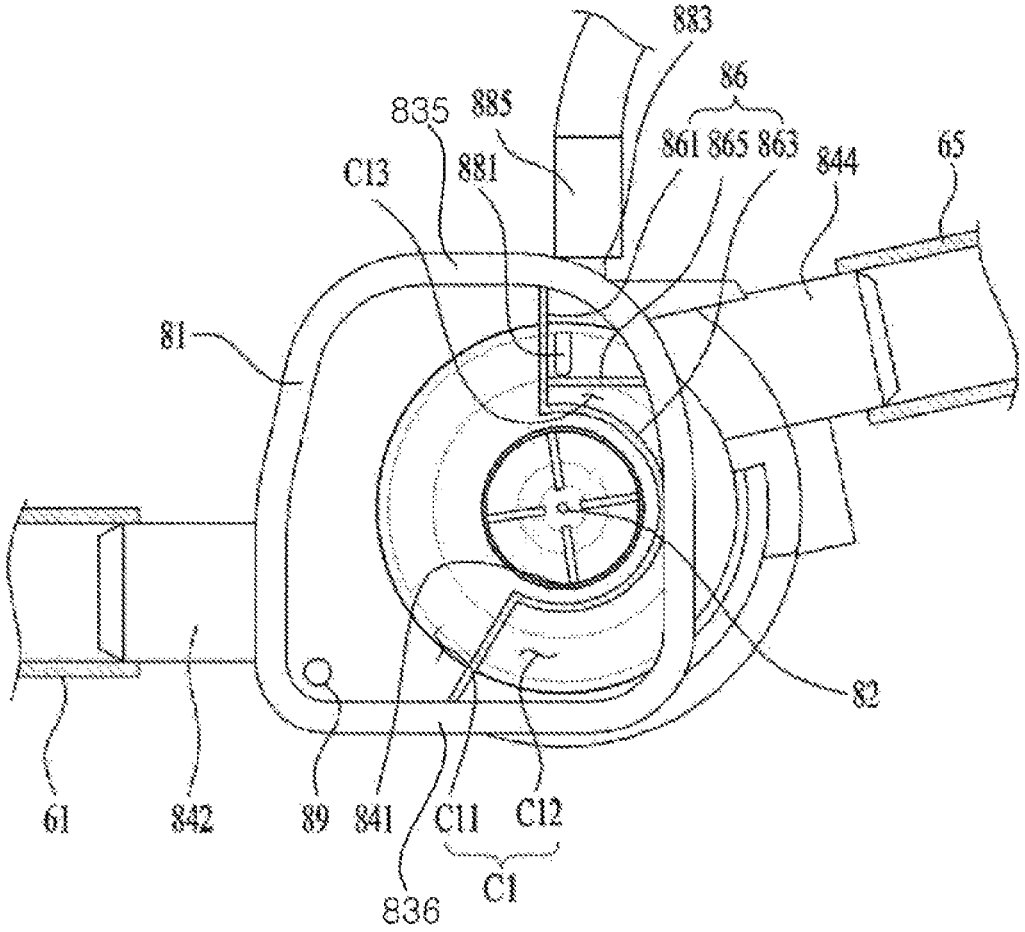
FIG. 7 shows an example of the first chamber partition and the second chamber partition provided in the pump.

Referring to FIG. 7, the pump 8 may further include a second chamber partition 86 forming a second buffer chamber C13. The second buffer chamber C13 may be formed inside the first chamber C1. The second buffer chamber C13 may not communicate with the passage chamber C11, the air chamber, and the first buffer chamber C12. Hereinafter, the second chamber partition 86 may also be referred to as a fourth partition 86.

The second chamber partition 86 may be formed by the chamber forming part 861 and a buffer chamber forming wall 863. As described above, when the chamber forming part 861 may be provided as a wall (an air chamber forming wall) that forms an air chamber in a space located above the chamber communicating hole 841 when a water level of the passage chamber C11 reaches a preset water level. The buffer chamber forming wall 863 may be provided as a wall that connects a free end of the air chamber forming wall and a side surface of the first chamber C1 or the first chamber partition 85.

When the second buffer chamber C13 is provided, the partition through-hole 881 may be provided to communicate the second chamber C2 and the second buffer chamber C13, and the exhaust pipe 883 may be provided to discharge the air inside the second buffer chamber C13 to the outside of the housing 83.

Further, the second buffer chamber C13 may further include a buffer chamber partition 865 that is provided to connect the chamber forming part (air chamber forming wall) 863 and a side surface of the first chamber C1, so that the second buffer chamber C13 is divided into a space communicating with the partition through-hole 881 and a space not communicating with the partition through-hole 881. Since the functions of the second buffer chamber 13 and the space not communicating with the partition through-hole 881 are the same as the function of the first buffer chamber C11, and thus, a detailed description thereof will be omitted.

Referring to FIGS. 1 to 7, a clothing treatment apparatus according to an aspect of the present disclosure includes a cabinet, a tub disposed inside the cabinet and providing a space in which water is stored, a drum rotatably provided in the tub, and a pump having a supply port connected to the tub and a discharge port connected to the outside of the cabinet. The pump includes: a housing; a first chamber disposed inside the housing and communicating with the supply port, a second chamber disposed inside the housing and communicating with the discharge port; a first partition for separating the first chamber and the second chamber; a chamber communicating hole formed in the first partition and communicating the first chamber and the second chamber; an impeller rotatably provided inside the second chamber; and a second partition located in the first chamber and extending downward from a first surface of the housing, which provides an upper boundary of the first chamber.

According to another aspect of the present disclosure, the second partition may extend from the first surface of the housing to an edge of the chamber communicating hole.

According to another aspect of the present disclosure, the second partition may extend from the first surface of the housing to a point located above a center of the chamber communicating hole in the edge of the chamber communicating hole.

According to another aspect of the present disclosure, the second partition may extend from the first surface of the housing to an uppermost point in the edge of the chamber communicating hole.

According to another aspect of the present disclosure, the second partition may divide an upper portion of the first chamber into a first upper region and a second upper region. The pump may further include a partition through-hole located in the second upper region, formed in the first partition, and communicating the second chamber with the second upper region.

According to another aspect of the present disclosure, the partition through-hole may be located above a lower end of the second partition.

The clothing treatment apparatus according to another aspect of the present disclosure may further include an exhaust pipe for communicating the second upper region with the outside of the housing.

The clothing treatment apparatus according to another aspect of the present disclosure may further include a flow rate control wall extending from the second partition to the second upper region and spaced apart from the housing.

According to another aspect of the present disclosure, the flow rate control wall may be disposed between the partition through-hole and the chamber communicating hole.

The clothing treatment apparatus according to another aspect of the present disclosure may further include a connecting pipe connecting the exhaust pipe and the tub. The tub may include a tub cover forming an upper surface of the tub. The connector may be connected to the tub cover.

The clothing treatment apparatus according to another aspect of the present disclosure may further include a residual water discharge pipe for communicating a lower portion of the first chamber with the outside of the housing, and a lid configured to open and close the residual water discharge pipe.

According to another aspect of the present disclosure, the first chamber may include a passage chamber communicating with the supply port and the chamber communicating hole, and a buffer chamber disposed below the chamber communicating hole and not communicating with the supply port and the chamber communicating hole. The pump may further include a third partition for partitioning the passage chamber and the buffer chamber from each other.

According to another aspect of the present disclosure, the second partition may be located in the passage chamber.

According to another aspect of the present disclosure, the third partition may include an inclined surface extending from a second surface of the housing, which provides a lower boundary of the first chamber, and inclined upward from the supply port in a direction toward the chamber communicating hole. The third partition may include a guide surface connecting a first surface of the housing and a second surface of the housing and extending downward along an edge of the chamber communicating hole from a surface located opposite to the supply port. The third partition may include an extension surface connecting the inclined surface and the guide surface.

According to another aspect of the present disclosure, the tub may have an extended cylindrical shape with a diameter greater than a length thereof.

Certain embodiments or other embodiments of the disclosure described above are not mutually exclusive or distinct from each other. Any or all components of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothing treatment apparatus comprising:
- a cabinet;
- a tub disposed inside the cabinet to provide a space in which water is stored;
- a drum rotatably provided inside the tub; and
- a pump comprising:
  - a supply port connected to the tub;
  - a discharge port connected to an outside of the cabinet; and
  - a housing including:
    - a first chamber located in the housing, the first chamber being in communication with the supply port;
    - a second chamber located in the housing, the second chamber being in communication with the discharge port;
    - a first partition separating the first chamber and the second chamber;
    - a chamber communicating hole located in the first partition, the first chamber being in communication with the second chamber via the chamber communicating hole;
    - an impeller rotatably provided in the second chamber; and
    - a second partition located in the first chamber, the second partition extending downward from a first surface of the housing, the first surface defining an upper boundary of the first chamber,
    - wherein the second partition extends from the first surface of the housing to an edge of the chamber communicating hole.

2. The clothing treatment apparatus of claim 1, wherein the second partition extends from the first surface of the housing to a point located above a center of the chamber communicating hole at the edge of the chamber communicating hole.

3. The clothing treatment apparatus of claim 1, wherein the second partition extends from the first surface of the housing to an uppermost point of an edge of the chamber communicating hole.

4. The clothing treatment apparatus of claim 1, wherein the second partition divides an upper portion of the first chamber into a first upper region and a second upper region, and wherein the first partition has a partition through-hole located in the second upper region, the second chamber being in communication with the second upper region via the partition through-hole.

5. The clothing treatment apparatus of claim 4, wherein a lower end of the second partition extends past the partition through-hole.

6. The clothing treatment apparatus of claim 4, further comprising an exhaust pipe in communication with the second upper region.

7. The clothing treatment apparatus of claim 6, wherein the housing further includes a flow rate control wall extending from the second partition to the second upper region, the flow rate control wall being spaced from the first surface of the housing.

8. The clothing treatment apparatus of claim 7, wherein the flow rate control wall is located between the partition through-hole and the chamber communicating hole.

9. The clothing treatment apparatus of claim 7, wherein the flow rate control wall extends across the partition through-hole.

10. The clothing treatment apparatus of claim 6, wherein the tub comprises a tub cover forming an upper surface of the tub, and wherein the housing includes a connecting pipe connecting the exhaust pipe to the tub cover.

11. The clothing treatment apparatus of claim 4, wherein the housing includes a third partition dividing the first chamber into a passage chamber and a first buffer chamber, the passage chamber being in communication with the supply port, the first buffer chamber not being in communication with the supply port.

12. The clothing treatment apparatus of claim 11, wherein the second partition is located in the passage chamber.

13. The clothing treatment apparatus of claim 12, wherein the housing includes a fourth partition in the first chamber, and wherein the second partition and the fourth partition define a second buffer chamber, the second buffer chamber not being in communication with the passage chamber and the first buffer chamber.

14. The clothing treatment apparatus of claim 13, wherein the fourth partition is located below the partition through-hole.

15. The clothing treatment apparatus of claim 12, wherein the housing includes a water discharge pipe in communication with the passage chamber.

16. The clothing treatment apparatus of claim 1, wherein the housing includes a third partition dividing the first chamber into a passage chamber and a first buffer chamber, the passage chamber being in communication with the supply port, the first buffer chamber not being in communication with the supply port.

17. The clothing treatment apparatus of claim 16, wherein the second partition is located in the passage chamber.

18. The clothing treatment apparatus of claim 17, wherein the housing includes a fourth partition in the first chamber, the second partition and the fourth partition defining a second buffer chamber, the fourth partition chamber not being in communication with the passage chamber and the first buffer chamber.

19. The clothing treatment apparatus of claim 1, wherein the housing includes a water discharge pipe in communication with the first chamber.

* * * * *